US011798712B2

(12) United States Patent
Villano et al.

(10) Patent No.: US 11,798,712 B2
(45) Date of Patent: Oct. 24, 2023

(54) ELECTRICAL BUSHING HAVING AN ANTI-ROTATION MOUNTING FLANGE AND METHOD FOR MOUNTING THE SAME

(71) Applicant: HITACHI ENERGY SWITZERLAND AG, Baden (CH)

(72) Inventors: Daniele Villano, Gebenstorf (CH); Christoph Hug, Endingen (CH); Besim Mehmeti, Urdorf (CH)

(73) Assignee: Hitachi Energy Switzerland AG, Baden (CH)

( * ) Notice: Subject to any disclaimer, the term of this patent is extended or adjusted under 35 U.S.C. 154(b) by 234 days.

(21) Appl. No.: 17/271,787

(22) PCT Filed: Aug. 27, 2019

(86) PCT No.: PCT/EP2019/072867
§ 371 (c)(1),
(2) Date: Feb. 26, 2021

(87) PCT Pub. No.: WO2020/043731
PCT Pub. Date: Mar. 5, 2020

(65) Prior Publication Data

US 2021/0350959 A1 Nov. 11, 2021

(30) Foreign Application Priority Data

Aug. 30, 2018 (EP) ..... 18191742

(51) Int. Cl.
*H01B 17/26* (2006.01)

(52) U.S. Cl.
CPC ..... *H01B 17/265* (2013.01)

(58) Field of Classification Search
CPC ..... H01B 17/265; H01B 17/38; H01B 17/583
See application file for complete search history.

(56) References Cited

U.S. PATENT DOCUMENTS 3,433,893 A 3/1969 Hofmann et al.
4,316,054 A 2/1982 Willem
(Continued)

FOREIGN PATENT DOCUMENTS

CN 101577154 A 11/2009
CN 102473490 A 5/2012
(Continued)

OTHER PUBLICATIONS

Chinese First Office Action dated Feb. 8, 2022 for Chinese Patent Application No. 201980051668.X, 11 pages (including English summary).
(Continued)

*Primary Examiner* — Paresh Paghadal
(74) *Attorney, Agent, or Firm* — Sage Patent Group

(57) ABSTRACT

An electrical bushing having an anti-rotation mounting flange for preventing rotation of a body element of the electrical bushing is provided. The electrical bushing includes a mounting flange, at least one locking element and a body element having a circumferential protrusion. At least one first recess is formed in the circumferential protrusion, and the at least one locking element is configured to engage with the at least one first recess and with the mounting flange for restricting relative rotation of the body element relative to the mounting flange about a longitudinal axis R. A further aspect provides an electrical transformer including at least one electrical bushing according to the above. A yet further aspect provides a method for mounting the electrical bushing according to the above.

12 Claims, 5 Drawing Sheets

(56) References Cited

U.S. PATENT DOCUMENTS

| | | | | |
|---|---|---|---|---|
| 5,952,617 | A | 9/1999 | Bergstrom | |
| 6,533,461 | B2 | 3/2003 | Gottlieb | |
| 8,535,191 | B1 | 9/2013 | Gall et al. | |
| 9,721,704 | B2 | 8/2017 | Sugimoto | |
| 9,741,475 | B2 | 8/2017 | Elder et al. | |
| 9,837,192 | B2 | 12/2017 | Alfier et al. | |
| 2012/0178294 | A1 | 7/2012 | Mattozzi et al. | |
| 2013/0292170 | A1 | 11/2013 | Kaddas et al. | |
| 2016/0093422 | A1* | 3/2016 | Elder | H01B 17/30 174/652 |
| 2017/0287601 | A1* | 10/2017 | Engels | H01B 17/303 |

FOREIGN PATENT DOCUMENTS

| | | | |
|---|---|---|---|
| CN | 103515893 | A | 1/2014 |
| CN | 106981768 | A | 7/2017 |
| CN | 107077929 | A | 8/2017 |
| EP | 0051715 | A2 | 5/1982 |
| EP | 2117015 | A1 | 11/2009 |
| FR | 2865859 | A1 | 8/2005 |
| JP | S5984724 | U | 6/1984 |
| JP | 2009016193 | A | 7/2007 |
| WO | 2016048742 | A1 | 3/2016 |

OTHER PUBLICATIONS

Chinese Notification to Grant Patent Right for Invention dated Aug. 31, 2022 for Chinese Patent Application No. 201980051668X, 4 pages (English translation).

International Search Report and Written Opinion of the International Searching Authority, PCT/EP2019/072867, dated Oct. 11, 2019, 16 pages.

Extended European Search Report dated Feb. 13, 2019 for European Patent Application No. 18191742.8, 8 pages.

Korean Decision for Grant of Patent dated Apr. 21, 2023 for Korean Patent Application 10-2021-7005119, 5 pages (including English translation).

* cited by examiner

ELECTRICAL BUSHING HAVING AN ANTI-ROTATION MOUNTING FLANGE AND METHOD FOR MOUNTING THE SAME

CROSS REFERENCE TO RELATED APPLICATIONS

This application is a 35 U.S.C. § 371 national stage application of PCT International Application No. PCT/EP2019/072867 filed on Aug. 27, 2019, which in turns claims foreign priority to European Patent Application No. 18191742.8, filed on Aug. 30, 2018, the disclosures and content of which are incorporated by reference herein in their entirety.

FIELD OF THE DISCLOSURE

Embodiments of the present disclosure generally relate to an electrical bushing having an anti-rotation mounting flange, especially in a high-voltage transformer. In particular, embodiments of the present disclosure relate to an electrical bushing having an anti-rotation mounting flange, wherein a locking element may be inserted to restrict rotation of the bushing body about a longitudinal axis. More particularly, embodiments of the present disclosure relate to a method for mounting an electrical bushing having an anti-rotation mounting flange.

TECHNICAL BACKGROUND

High-voltage transformers typically include a number of electrical bushings provided therein to facilitate isolation of conductors passing through a barrier, such as a grounded transformer housing. Electrical bushings for high-voltage applications may include a dielectric body component and a means for mounting the bushing to a mounting surface. The dielectric body component may be at least partially immersed in an insulating oil, and the status of the electrical bushing shall be periodically inspected and maintained. Inspection of the electrical bushing is achieved by providing a measurement tap in a side portion of the body component for installation of a measurement device. The measurement tap typically extends laterally from the body component and may be accessible by means of an access hole in a mounting flange of the electrical bushing.

In existing high-voltage electrical bushings, the mounting flange typically clamps a portion of the body component of the bushing. The install position of the bushing is set by rotating the body component within the mounting flange to the correct position for accessing the measurement tap. However, existing mounting flange designs may still allow for the body component to rotate after installation if a tangential force is applied thereto. Further, when subjected to an unintentional rotation, an electrical bushing having a measurement device installed in the measurement tap may cause damage to the measurement device and/or the measurement tap, potentially compromising the insulating performance of the electrical bushing, the performance of the measurement device, or hindering inspection and/or maintenance of the electrical bushing.

International patent application publication WO 2016/048742 A1 describes an insulating device including a body portion having an outer surface comprising a first projection portion, and a flange portion having a flange opening into which the body portion is received having an inner surface comprising a first projection opening. The first projection opening receives the first projection portion of the body portion when the body portion is inserted into the flange opening of the flange portion such that rotational movement of the body portion with respect to the flange portion is limited.

French patent application publication FR 2865859 A1 describes a bushing fixing device, wherein a fixed flange having locating tabs is welded to the mounting wall of a piece of equipment around an opening. A bushing is inserted into the opening so that protrusions locate within the locating tabs of the fixed flange to prevent rotation of the bushing. A movable flange is then used to fix the bushing to the fixed flange using a rotational tightening motion, the movable flange engaging with ratchet features in bushing to prevent reverse rotation and loosening of the movable flange.

Japanese utility model application publication JP S59 84724 U describes an epoxy bushing including a flange which is clamped by an upper mounting flange and a lower mounting flange. A protrusion is provided on the body of the epoxy bushing, the protrusion engaging with a recess in the lower mounting flange to prevent rotation of the epoxy bushing with respect to the mounting flange.

One solution to preventing rotation of the body component with respect to the mounting flange is to use an adhesive to adhere the body component to the mounting flange. However, adhesive may require many hours to harden, which is not favorable for installing electrical bushings in a timely manner. Further, the use of adhesive results in difficulties in disassembly of the body component from the mounting flange. In view thereof, it is desired to overcome at least some of the problems in the prior art.

SUMMARY OF THE DISCLOSURE

An aspect of the present disclosure provides an electrical bushing. The electrical bushing 100 includes a mounting flange 200 including a main flange element 201 having a first bushing contact surface 208A, and a ring element 202 having a second bushing contact surface 208B; at least one locking element 203; a body element 101 comprising a circumferential protrusion 106 having a first flange contact surface 108A for contacting the first bushing contact surface 208A and a second flange contact surface 108B for contacting the second bushing contact surface 208B, wherein at least one first recess 107 is formed in the circumferential protrusion 106, and wherein the at least one locking element 203 is configured to engage with the at least one first recess 107 and with the mounting flange 200 for restricting relative rotation of the body element 101 relative to the mounting flange about a longitudinal axis R.

A further aspect of the present disclosure further provides an electrical transformer including at least one electrical bushing 100 according to the above.

A yet further aspect of the present disclosure further provides a method for mounting the electrical bushing 100 according to the above. The method includes fastening the mounting flange 200 to a mounting surface 50, rotating the body element 101, and inserting the at least one locking element 203 such that the at least one locking element 203 engages with the at least one first recess 107 and with the mounting flange 200.

The embodiments described in the present disclosure allow for preventing the unintentional rotation of an electrical bushing about a longitudinal axis. Further, the embodiments allow for the time-efficient installation of an electrical bushing which is prevented from unintentional rotation. Furthermore, the embodiments allow for the prevention of damage to an electrical bushing having a measurement device installed caused by unintentional rotation of the electrical bushing.

Further advantages, features, aspects and details that can be combined with embodiments described herein are evident from the dependent claims, claim combinations, the description and the drawings.

BRIEF DESCRIPTION OF THE FIGURES

The details will be described in the following with reference to the figures, wherein.

DETAILED DESCRIPTION OF THE FIGURES AND OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations, with the scope thereof for which protection is sought being defined by the claims.

Within the following description of the drawings, the same reference numbers refer to the same or to similar components. Generally, only the differences with respect to the individual embodiments are described. Unless specified otherwise, the description of a part or aspect in one embodiment can be applied to a corresponding part or aspect in another embodiment as well.

Figure 1:
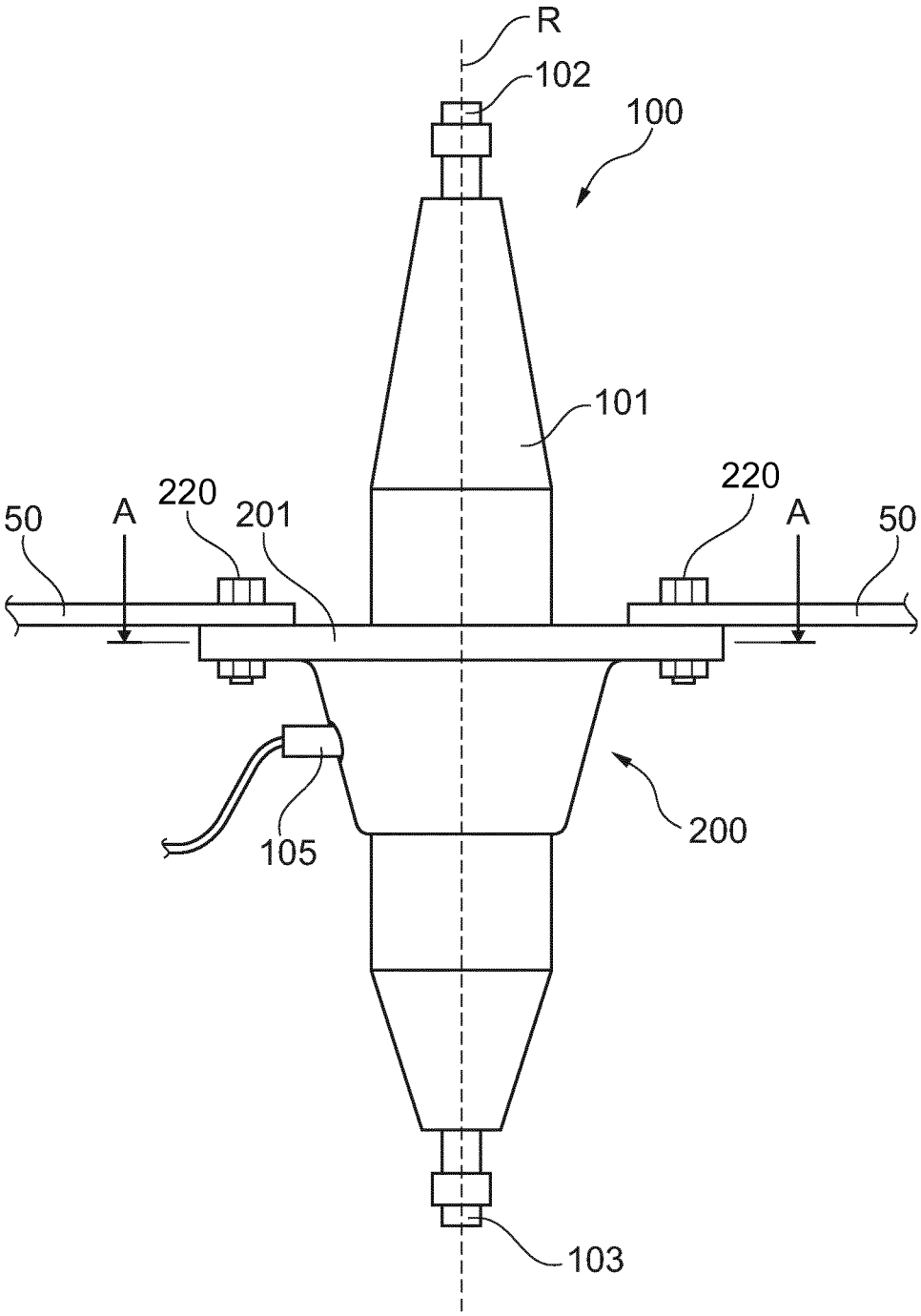
FIG. 1 is a schematic side view of an electrical bushing according to embodiments of the disclosure.
Figure 2:
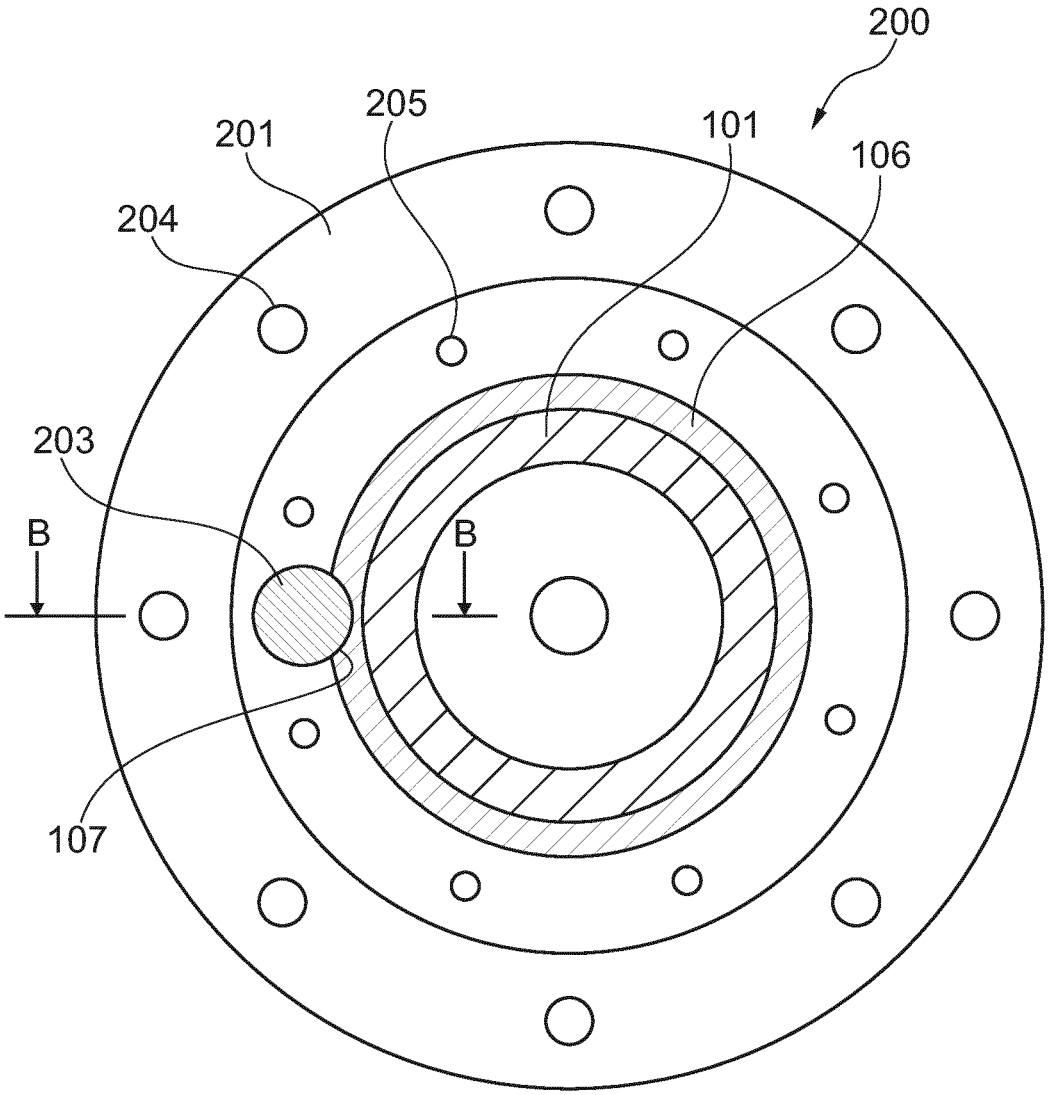
FIG. 2 is a schematic cross-sectional view A-A of an electrical bushing according to an embodiment of the disclosure.
Figure 3:
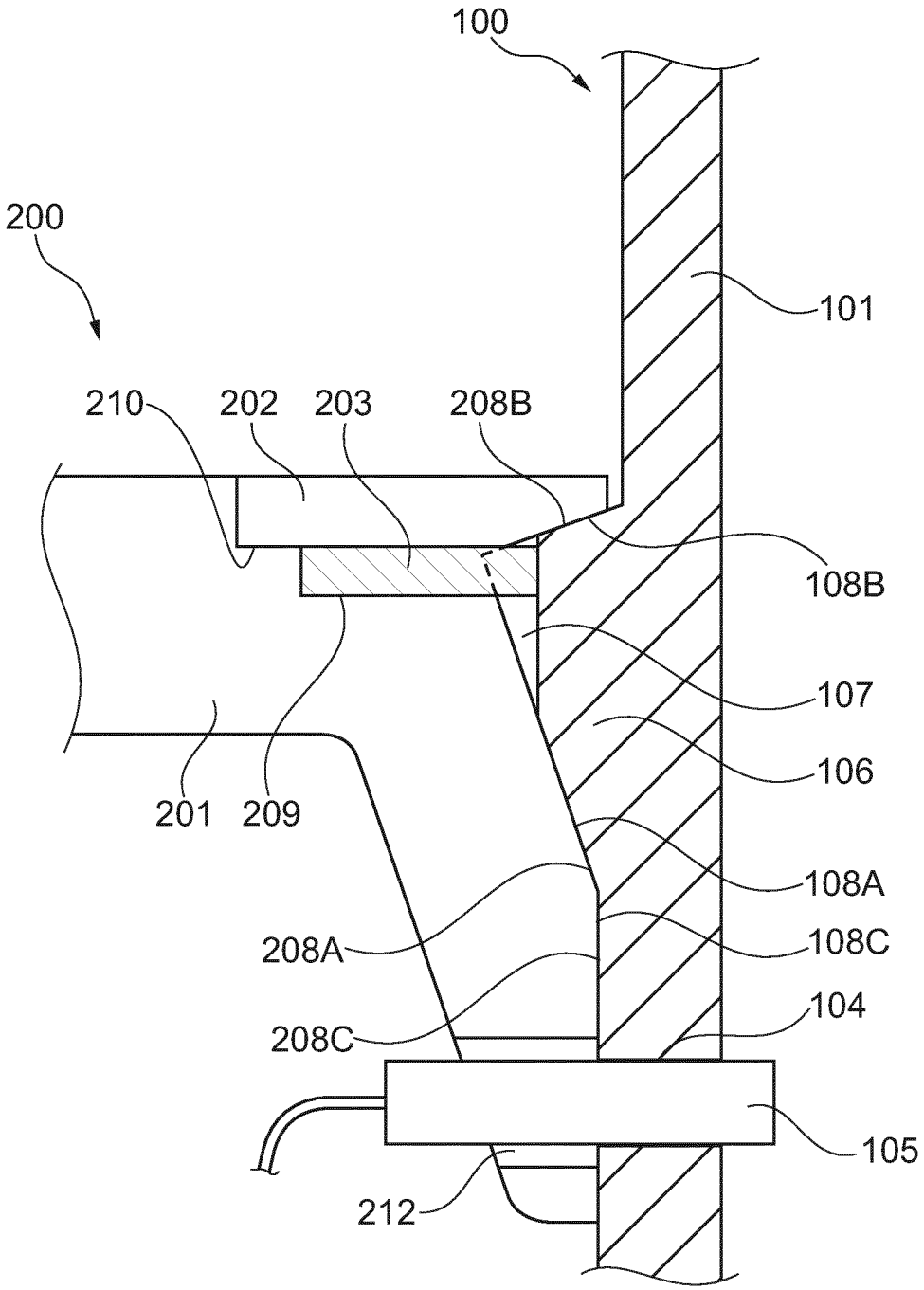
FIG. 3 is a schematic cross-sectional view B-B of an electrical bushing according to an embodiment of the disclosure.

FIGS. 1 to 3 show an electrical bushing 100 according to an embodiment of the present disclosure. The electrical bushing 100 comprises a mounting flange 200 comprising a main flange element 201 having a first bushing contact surface 208A and a ring element 202 having a second bushing contact surface 208B, at least one locking element 203, a body element 101 comprising a circumferential protrusion 106 having a first flange contact surface 108A for contacting the first bushing contact surface 208A and a second flange contact surface 108B for contacting the second bushing contact surface 208B, wherein at least one first recess 107 is formed in the circumferential protrusion 106, and wherein the at least one locking element 203 is configured to engage with the at least one first recess 107 and with the mounting flange 200 for restricting relative rotation of the body element 101 relative to the mounting flange 200 about a longitudinal axis R.

Reference will be made to FIG. 1, which shows a schematic side view of an electrical bushing 100 having a mounting flange 200 according to an embodiment of the disclosure. The mounting flange 200 may be mounted to a mounting surface 50. Mounting surface 50 may be a housing for an electrical device, particularly a housing for an electrical transformer, or a supporting tool for providing support during assembly of electrical bushing 100. In the case of mounting surface 50 being a housing of an electrical transformer, the electrical transformer may be in operation.

Electrical bushing 100 includes a body element 101. Body element 101 may have a substantially rotationally symmetrical form about a longitudinal axis R. Body element 101 serves to electrically isolate one or more conductors. Body element 101 may provide electrical isolation of one or more conductors by, for example, including a non-conductive or dielectric material. Particularly, body element 101 may be at least partially immersed in an isolating medium, for example a dielectric oil. Body element 101 may contain one or more layers of conductive material in specific positions, for example aluminium foil, in order to modify the gradient of the electric field. Alternatively, body element 101 may be filled with an isolating medium, for example a dielectric oil.

Electrical bushing 100 may include a number of terminals. As exemplarily shown in FIG. 1, electrical bushing 100 includes an upper terminal 102 and a lower terminal 103. Upper terminal 102 and lower terminal 103 may be configured for mounting at least one conductor thereto. For example, upper terminal 102 and lower terminal 103 may include a threaded portion configured for receiving at least one fastener for securely mounting at least one conductor thereto. Upper terminal 102 and lower terminal 103 may be respective upper and lower ends of a conductor passing through electrical bushing 100.

Electrical bushing 100 may be used in medium-voltage or high-voltage applications. In the context of the present disclosure, the term "medium-voltage" may refer to a voltage of at least 1 kV and up to 52 kV. Further, the term "high-voltage" in the context of the present disclosure may refer to a voltage of at least 52 kV.

Mounting flange 200 may be provided for mounting the electrical bushing 100 to a mounting surface 50. For example, mounting flange 200 may include a number of flange mounting holes 204. Flange mounting holes 204 may be arranged along the periphery of mounting flange 200. Fasteners 220 may be provided for securely fastening mounting flange 200 to mounting surface 50 such that fasteners 220 pass through flange mounting holes 204.

Mounting flange 200 includes a main flange element 201 and a ring element 202. Main flange element 201 and ring element 202 are shaped so as to surround body element 101, respectively. For example, main flange element 201 and ring element 202 may be substantially rotationally symmetrical about longitudinal axis R. Main flange element 201 and ring element 202 are configured to be mounted together to form mounting flange 200. For example, main flange element 201 may include a number of threaded holes 205 for fastening ring element 202 thereto. Main flange element 201 may further include a ring element recess 210 which is configured for receiving ring element 202.

Body element 101 includes a circumferential protrusion 106. Circumferential protrusion 106 may protrude from body element 101 in a substantially radial direction from an outer surface of body element 101, i.e. in a direction substantially perpendicular to longitudinal axis R. Circumferential protrusion 106 allows for body element 101 to engage with mounting flange 200. Particularly, circumferential protrusion 106 engages with main flange element 201 and ring element 202. As exemplarily shown in FIG. 3, circumferential protrusion 106 engages with main flange element 201 and ring element 202 such that main flange element 201 and ring element 202 may have a clamping effect on circumferential protrusion 106. Through this engagement with mounting flange 200, circumferential protrusion 106 provides support to electrical bushing 100 in the axial direction, i.e. in the direction along longitudinal axis R. In the case where electrical bushing 100 is installed in a vertical orientation, i.e. such that longitudinal axis R is substantially aligned with the force of gravity, circumferential protrusion 106 provides support against the force of gravity.

Circumferential protrusion 106 includes a first flange contact surface 108A and a second flange contact surface 108B. Correspondingly, main flange element 201 includes a first bushing contact surface 208A and ring element 202 includes a second bushing contact surface 208B. First flange contact surface 108A may be provided at an angle to longitudinal axis R such that the first flange contact surface 108A forms a first tapered portion of the circumferential protrusion 106. Similarly, second flange contact surface 108B may be provided at an angle to longitudinal axis R such that second flange contact surface 108B forms a second tapered portion of the circumferential protrusion 106.

The angle between first flange contact surface 108A or second flange contact surface 108B and longitudinal axis R may be, for example, at least 10°. Alternatively, the angle between flange contact surface 108A or second flange contact surface 108B and longitudinal axis R may be up to 90°. For example, circumferential protrusion 106 may have a rectangular cross-section wherein first contact surface 108A and second contact surface 108B are parallel and perpendicular to longitudinal axis R. Alternatively, the circumferential protrusion 106 may have a triangular cross-section wherein the angle between first contact surface 108A and/or second contact surface 108B and longitudinal axis R is between 0° and 90°, such that at least one portion of the circumferential protrusion 106 is tapered.

According to an embodiment, which may be combined with other embodiments described herein, body element 101 may further include at least a third flange contact surface 108C. Correspondingly, main flange element 201 may include a third bushing contact surface 208C. Third flange contact surface 108C may engage with third bushing contact surface 208C. Third flange contact surface 108C may be, for example, an outer surface of body element 101 or may alternatively be a further surface of circumferential protrusion 106.

As exemplarily shown in FIG. 3, third flange contact surface 108C is provided at an angle different to the angle of first flange contact surface 108A. Particularly, third flange contact surface 108C is provided at an angle substantially parallel to longitudinal axis R, such that third flange contact surface 108C and third bushing contact surface 208C engage in a substantially radial direction. Third flange contact surface 108C and third bushing contact surface 208C provide electrical bushing 100 with additional support in the direction perpendicular to the longitudinal axis R. For example, when electrical bushing 100 is mounted in a substantially horizontal direction, additional support is provided against the force of gravity.

Circumferential protrusion 106 includes at least one first recess 107. At least one first recess 107 may be preferably formed in circumferential protrusion 106 during assembly of mounting flange 200 to body element 101. For example, after mounting flange 200 is mounted to body element 101, and after body element 101 is rotated about longitudinal axis R into a final position, at least one first recess 107 may be formed in circumferential protrusion 106, for example using a machining process. Alternatively, at least one first recess 107 may be formed in circumferential protrusion 106 during installation of electrical bushing 100, or prior to assembly of mounting flange 200 to body element 101, i.e. during manufacture of body element 101.

According to an embodiment, which may be combined with other embodiments described herein, at least one first recess 107 may include a longitudinal groove. In other words, at least one first recess 107 may include a recess having a cross-section and extending substantially in the direction of longitudinal axis R. For example, when the longitudinal groove is projected in a radial direction, the resulting projection may extend along longitudinal axis R. The cross-section of the at least one first recess may include a circular shape, a rectangular shape, a triangular shape or an elliptical shape. The longitudinal groove may extend completely through circumferential protrusion 106 such that both ends of the longitudinal groove are open. Alternatively, the longitudinal groove may extend only partially through circumferential protrusion 106 such that one end of the longitudinal groove is closed and the other end of the longitudinal groove is open.

Referring to FIGS. 2 and 3, electrical bushing 100 further includes at least one locking element 203. Locking element 203 is configured to engage with the at least one first recess 107 and with the mounting flange 200 for restricting relative rotation of the body element 101 relative to the mounting flange 200 about longitudinal axis R.

As exemplarily shown in FIGS. 2 and 3, locking element 203 may have a form that is substantially flat. Particularly, locking element 203 may have a form that is substantially thin in the direction parallel to longitudinal axis R relative to the directions perpendicular to longitudinal axis R. For example, locking element 203 may include a thin plate having a shape corresponding to the shape of the at least one first recess 107.

Alternatively, locking element 203 may have a form that is substantially pin-like. Particularly, locking element 203 may have a form that is substantially long in the direction parallel to longitudinal axis R relative to the directions perpendicular to longitudinal axis R. For example, locking element 203 may include a pin having a cross-section corresponding to the shape of the at least one first recess 107. Locking element 203 may include a cylindrical pin shape or a cuboid key shape.

Locking element 203 is configured to engage with a corresponding first recess 107. In the context of the present disclosure, the term "engage" may refer to full engagement on a contact surface or a partial engagement on a contact surface. For example, locking element 203 and first recess 107 may have the shapes which correspond to one another, such that locking element 203 and the at least first recess 107 engage each other across the an entire contact surface. Alternatively, locking element 203 and first recess 107 may have shapes which are different to one another, such that locking element 203 partially engages with the at least first recess 107. In either case, the full or partial engagement of locking element 203 and first recess 107 restricts relative rotation of the body element 101 relative to the mounting flange 200 about longitudinal axis R.

In the context of the present disclosure, locking element 203 is a component which is separate from body element 101 and mounting flange 200. Particularly, locking element 203 is configured to be insertable into and/or removable from a location where locking element 203 engages with body element 101 and mounting flange 200, more particularly locking element 203 engages with the at least one first recess 107 and mounting flange 200. Having a separate locking element 203 allows for rotation of body element 101 during installation and/or maintenance without lifting body element 101 out of mounting flange 200, while also allowing for rotation to be restricted once the appropriate position is achieved. Such an advantage is not achievable if locking element 203 is an integral element of body element 101 or mounting flange 200, as this renders locking element 203 non-removable, requiring body element 101 to be removed from mounting flange 200 in order for body element 101 to be rotated or re-positioned.

According to an embodiment, which may be combined with other embodiments described herein, main flange element 201 further includes at least one second recess 209. The at least one second recess 209 is provided such that the at least one locking element 203 engages with the at least one second recess 209. As exemplarily shown in FIG. 3, the at least one second recess 209 may formed in main flange element 201 such that locking element 203 may be inserted therein.

According to an embodiment, which may be combined with other embodiments described herein, the at least one locking element 203 is retained by ring element 202. In the present disclosure, the term "retained" refers to a retained element being held in a specific position such that the retained element does not move relative to at least the retaining element. For example, the at least one locking element 203 may be installed in a position such that the at least one locking element 203 engages with the at least one recess 107 and with mounting flange 200, and ring element 202 may be installed thereon so as to retain the at least one locking element 203. Particularly, main flange element 201, the at least one locking element 203 and ring element 202 may be arranged in a sandwich arrangement as exemplarily shown by FIG. 3. Ring element 202 may be fastened to main element 201 using, for example, fasteners engaging with threaded holes 205.

Figure 4:
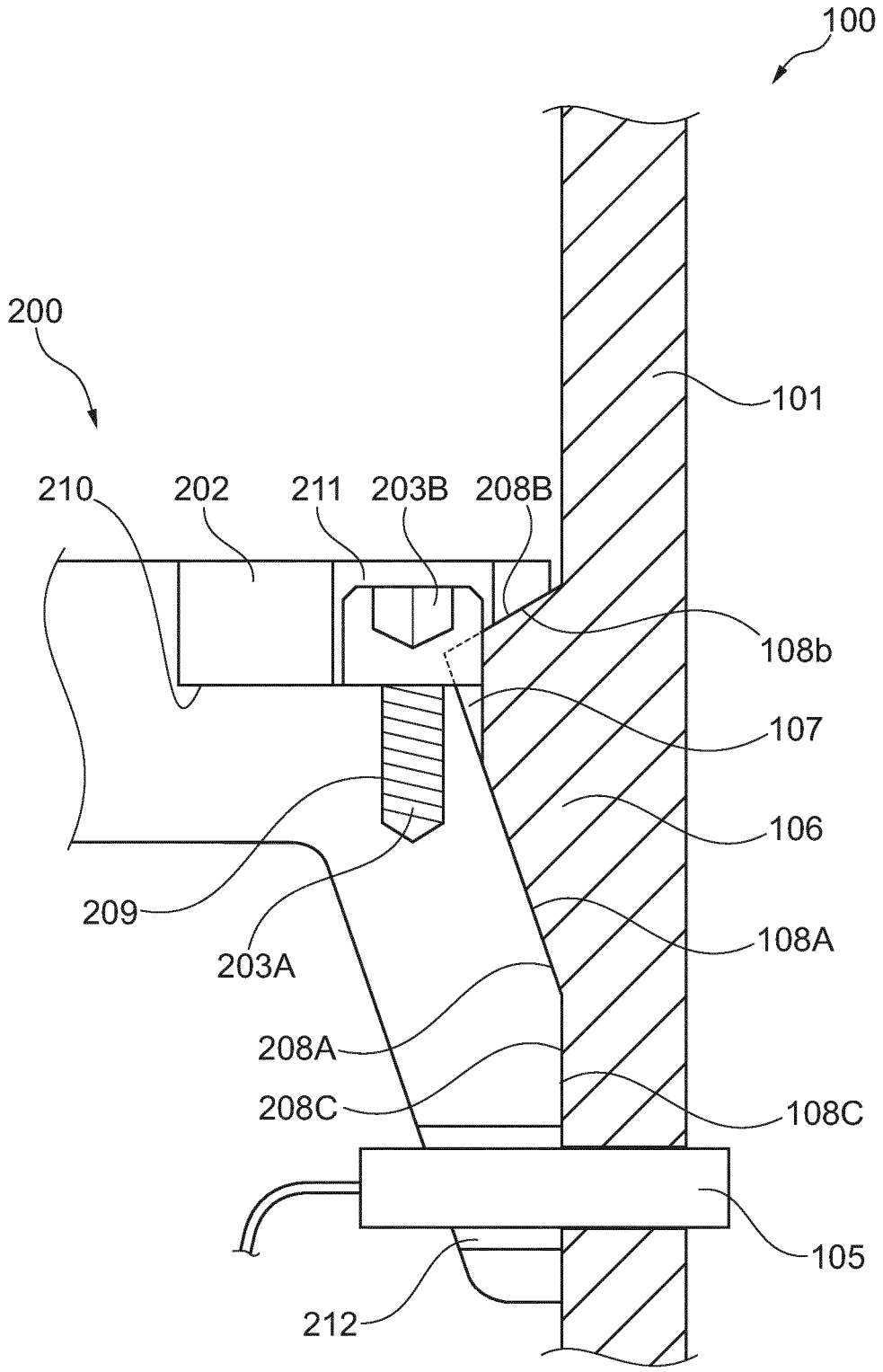
FIG. 4 is a schematic cross-sectional view B-B of an electrical bushing according to another embodiment of the disclosure.

Reference will now be made to FIG. 4, which exemplarily shows a cross-sectional view of an electrical bushing 100. According to an embodiment, which may be combined with other embodiments described herein, the at least one second recess 209 may be a threaded hole 209, and the at least one locking element 203 includes a threaded portion 203A for engaging with the at least one threaded hole 209 and a head portion 203B for engaging with the at least one first recess 107. Particularly, the at least one locking element 203 may be a bolt or a screw.

As exemplarily shown in FIG. 4, the ring element 202 may further include a locking element access opening 211. Locking element access opening 211 allows for the head portion 203B of locking element 203 to be accessible without unmounting ring element 202. Further, locking element access opening 211 allows for ring element 202 to be installed before locking element 203 is inserted, so that the electric bushing 100 is provided with additional support during installation and prior to rotating the body element 101 into a final position. Furthermore, locking element access opening 211 allows for locking element 203 to be easily removed in the case where, for example, body element 101 requires repositioning.

Alternatively, main flange element 201 may further include a head portion recess (not shown). A head portion recess allows for head portion 203B of the locking element 203 to be recessed into main flange element 201 so that ring element 202 does not require a locking element access opening 211.

According to an embodiment, which may be combined with other embodiments described herein, electrical bushing 100 may further include at least one measurement hole 104. Measurement hole 104 may be formed in body element 101 such that access to the internal volume of body element 101 is facilitated. Mounting flange 200 may be provided with an access hole 212 such that measurement hole 104 may be accessed when mounting flange 200 is assembled to body element 101. Measurement hole 104 may be configured for accepting a measurement device 105. For example, measurement device 105 may be configured to measure the capacitance or dissipation factor of electrical bushing 100, which may be useful for determining the status of electrical bushing 100.

According to a further aspect of the present disclosure, an electrical transformer is provided. The electrical transformer includes at least one electrical bushing 100 according to any embodiments described herein. The electrical transformer may be, for example, a medium- or high-voltage electrical transformer.

However, the use of electrical bushing 100 according to embodiments of the present disclosure is not limited only to an electrical transformer. The electrical bushing 100 of the present disclosure may be used in any application where conductors are to be isolated. For example, the electrical bushing 100 of the present disclosure may be used in any medium- or high-voltage electrical distribution components including, but not limited to, electrical breakers, lightning arrestors, electrical relays, bus bars, etc.

Figure 5:
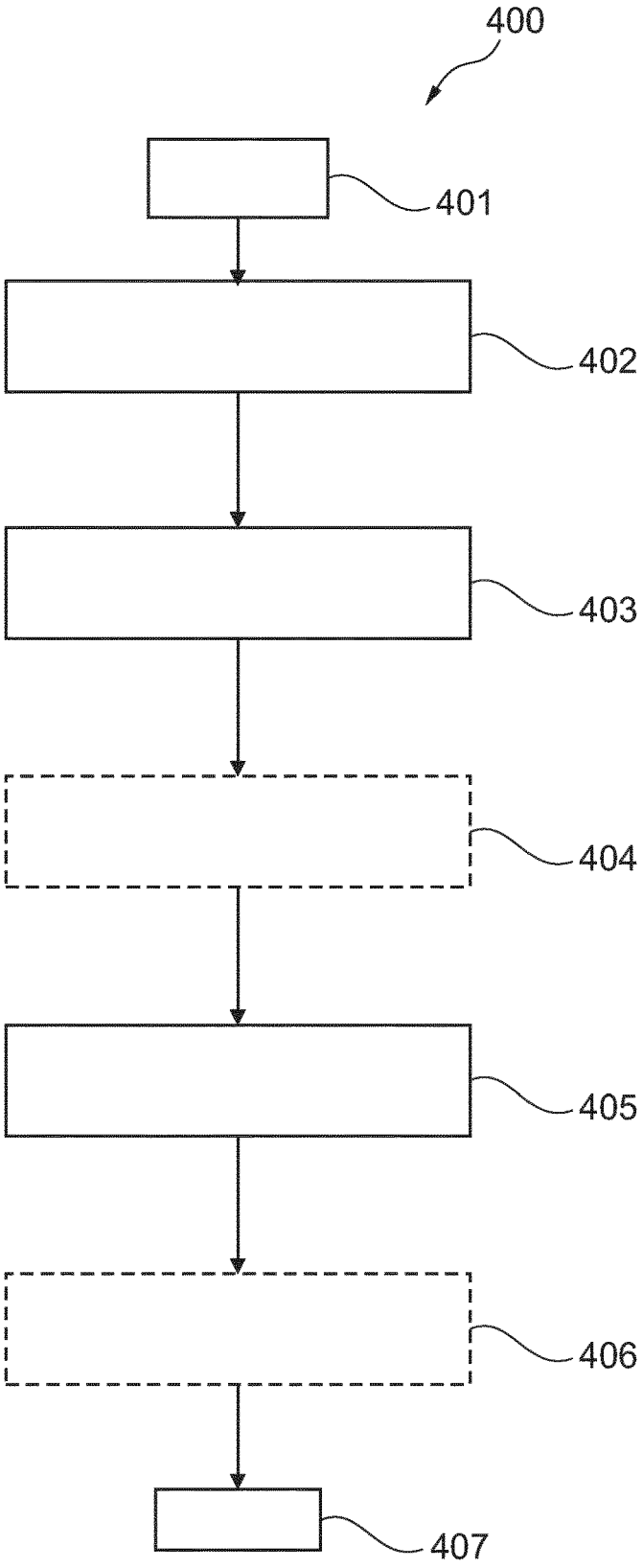
FIG. 5 is a flowchart of a method for mounting an electrical bushing according to an embodiment of the disclosure.

According to yet another aspect of the present disclosure, a method 400 for mounting an electrical bushing according to embodiments of the present disclosure is provided. Reference is now made to FIG. 5, which shows a flowchart of method 400. Method 400 commences at block 401. The method 400 includes fastening the mounting flange to a mounting surface at block 402, rotating the body element at block 403, and inserting the at least one locking element such that the at least one locking element engages with the at least one first recess and with the mounting flange at block 405. The method 400 concludes at block 407.

In block 402, method 400 includes fastening the mounting flange. Fastening the mounting flange 200 may involve fastening the mounting flange 200 to a mounting surface 50. For example, mounting surface 50 may be the housing of a transformer or a supporting tool for providing support during assembly of electrical bushing 100. The mounting flange 200 may be fastened such that the electrical bushing 100 passes through mounting surface 50. As described above, mounting flange 200 may include a number of flange mounting holes 204. Fasteners 220 may be provided for securely fastening mounting flange 200 to mounting surface 50 such that fasteners 220 pass through flange mounting holes 204 and the mounting surface 50.

In block 403, method 400 further includes rotating the body element. During installation or assembly of the electrical bushing 100, the rotational position of the body element 101 is adjusted by rotating the body element 101 about the longitudinal axis R. Rotating the body element may further include positioning body element 101 such that a measurement hole 104 of body element 101 is aligned with an access hole 212 of mounting flange 200. Aligning measurement hole 104 with access hole 212 allows for the installation of a measurement device 105.

In block 405, method 400 further includes inserting the at least one locking element. Inserting the at least one locking element 203 involves placing the at least one locking element 203 such that the at least one locking element 203 engages with the at least one first recess 107. According to some embodiments described above, the main flange element 201 may include at least a second recess 209. In this case, the inserting the at least one locking element 203 may involve placing the at least one locking element 203 such that the at least one locking element 203 engages with the at least one second recess. According to other embodiments described above, the locking element 203 may be a bolt or a screw. In this case, the inserting the at least one locking element 203 may involve screwing the locking element 203 into a respective threaded hole.

According to an embodiment, which may be combined with other embodiments described herein, method 400 may further include that, after rotating the electrical bushing in block 403, the at least one first recess is formed in the circumferential protrusion in block 404. The at least one first recess 107 may be formed during assembly of mounting flange 200 to electrical bushing 100 using, for example, a machining process.

Alternatively, the at least one first recess 107 may be formed during manufacture or assembly of the electrical bushing 100 using, for example, a machining process. The machining process may be a process which is suitable for use in the field and during installation of the electrical bushing, for example, a drilling operation or a milling operation.

Alternatively, the at least one first recess 107 may be formed during manufacture of body element 101. In this case, the at least one first recess 107 may include a plurality of first recesses 107 arranged circumferentially at a plurality of positions. While rotating the body element 101 at block 403, the body element 101 may be rotated to a position wherein one of the plurality of first recesses 107 is aligned in the final position. When one of the plurality of first recesses 107 is aligned, the at least one locking element 203 may be inserted.

According to embodiments described above, main flange element 201 may further comprise at least one second recess 209. In further embodiments, the at least one second recess 209 may be a threaded hole. In these cases, the method 400 may further include forming the at least one second recess 209 in the main flange element 201. Forming the at least one second recess 209 may be performed at the same time as forming the at least one first recess in block 404. The at least one second recess 209 may be formed using a machining process, for example, a drilling or milling process. Further, in the case where the at least one second recess 209 is a threaded hole, the machining process may further include a thread forming operation.

According to an embodiment, which may be combined with other embodiments described herein, method 400 may further include that, after inserting the at least one locking element in block 405, the ring element is mounted to retain the at least one locking element in block 406.

Mounting ring element 202 may include positioning ring element 202 onto main flange element 201, and may further include fastening ring element 202 to main flange element 201. For example, ring element 202 may be mounted by installing a number of fasteners into threaded holes 205. Mounting the ring element 202 may be performed after inserting the at least one locking element 203, such that main flange element 201, the at least one locking element 203 and the ring element 202 form a sandwich arrangement, wherein the locking element 203 is retained between the main flange element 201 and the ring element 202.

Alternatively, the ring element may be mounted prior to inserting the at least one locking element in block 405. According to an embodiment described above, ring element 202 may be configured to allow for locking element 203 to be inserted or removed when ring element 202 is mounted to main flange element 201. For example, locking element 203 may include a bolt or screw. In this case, ring element 202 may be mounted at any time prior to inserting the locking element 203, for example, during assembly of the electrical bushing 100.

While the foregoing is directed to aspects and embodiments of the disclosure, other and further embodiments of the disclosure may be devised without departing from the basic scope thereof, and the scope thereof is determined by the claims that follow.

The invention claimed is:

1. An electrical bushing comprising:

a mounting flange comprising a main flange element having a first circumferential bushing contact surface, and a ring element having a second circumferential bushing contact surface;

a body element extending along a longitudinal axis and surrounded by the main flange element and the ring element, the body element comprising a circumferential protrusion erecting from an outer surface of the body element in a radial direction substantially perpendicular to the longitudinal axis and having a first circumferential flange contact surface for contacting the first circumferential bushing contact surface, a second circumferential flange contact surface arranged sequentially with the first circumferential flange contact surface along the longitudinal axis and for contacting the second circumferential bushing contact surface, and at least one first recess traversing along the radial direction into a part of the circumferential protrusion and formed between the first circumferential flange contact surface and the second circumferential flange contact surface; and at least one locking element configured to restrict rotation of the body element relative to the mounting flange about the longitudinal axis by the at least one locking element being inserted into the at least one first recess and being held between the main flange element and the ring element.

2. The electrical bushing according to claim 1, wherein the at least one first recess traverses along the radial direction through the part of the circumferential protrusion.

3. The electrical bushing according to claim 1, wherein the main flange element further comprises at least one second recess for accommodating the at least one locking element.

4. The electrical bushing according to claim 1, wherein the at least one locking element is retained by the main flange element and the ring element.

5. The electrical bushing according to claim 1, wherein the main flange element further comprises a third circumferential bushing contact surface, and wherein the body element further comprises a third circumferential flange contact surface for contacting the third circumferential bushing contact surface.

6. The electrical bushing according to claim 1, wherein the body element further comprises a measurement access hole for accepting a measurement device.

7. The electrical bushing according to claim 1, wherein the body element comprises a dielectric material.

8. An electrical transformer comprising the electrical bushing according to claim 1.

9. A method for mounting the electrical bushing according to claim 1, the method comprising:

fastening the mounting flange to a mounting surface;

rotating the body element; and engaging the at least one locking element with the at least one first recess and with the mounting flange by inserting the at least one locking element into the at least one first recess and holding the at least one locking element between the main flange element and the ring element so as to restrict rotation of the body element relative to the mounting flange about the longitudinal axis.

10. The electrical bushing according to claim 1, wherein the first circumferential flange contact surface directly contacts the first circumferential bushing contact surface, and wherein the second circumferential flange contact surface directly contacts the second circumferential bushing contact surface.

11. The electrical bushing according to claim 1, wherein the at least one locking element, the mounting flange and the body element are separable from one another.

12. The electrical bushing according to claim 1, wherein the locking element engages with the at least one locking element is inserted into the at least one first recess and is held between the main flange element and the ring element.

* * * * *